US009944370B2

(12) United States Patent
Jamieson et al.

(10) Patent No.: US 9,944,370 B2
(45) Date of Patent: Apr. 17, 2018

(54) SUBSEA HOSTING OF UNMANNED UNDERWATER VEHICLES

(71) Applicant: Subsea 7 Limited, Sutton (GB)

(72) Inventors: James Andrew Jamieson, Balmedie (GB); Lee Wilson, Insch (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 15/121,027

(22) PCT Filed: Feb. 19, 2015

(86) PCT No.: PCT/GB2015/050488

§ 371 (c)(1),
(2) Date: Aug. 23, 2016

(87) PCT Pub. No.: WO2015/124938

PCT Pub. Date: Aug. 27, 2015

(65) Prior Publication Data

US 2017/0113768 A1 Apr. 27, 2017

(30) Foreign Application Priority Data

Feb. 24, 2014 (GB) ..... 1403220.5

(51) Int. Cl.
*B63G 8/00* (2006.01)

(52) U.S. Cl.
CPC ..... *B63G 8/001* (2013.01); *B63G 2008/004* (2013.01); *B63G 2008/005* (2013.01); *B63G 2008/007* (2013.01); *B63G 2008/008* (2013.01)

(58) Field of Classification Search
CPC ..... B63G 8/001
See application file for complete search history.

(56) References Cited

U.S. PATENT DOCUMENTS 6,167,831 B1 * 1/2001 Watt ..... B63G 8/001 114/245
6,223,675 B1 5/2001 Watt et al.
(Continued)

FOREIGN PATENT DOCUMENTS

WO WO 00/71415 11/2000
WO WO 2007/143457 12/2007
(Continued)

OTHER PUBLICATIONS

Stokey, Roger et al., "A Docking System for REMUS, an Autonomous Underwater Vehicle," Oceans '97, MTS/IEEE Conference Proceedings (vol. 2), Oct. 6, 1997, pp. 1132-1136.

*Primary Examiner* — Stephen P Avila
(74) *Attorney, Agent, or Firm* — Levy & Grandinetti

(57) ABSTRACT

A method of hosting an autonomous underwater vehicle ("AUV") at a subsea location lowers at least one AUV basket to a subsea location adjacent at least one preinstalled subsea structure. The subsea structure has provision for electrical power to be provided to it. At the subsea location, the, or each, basket is connected to the, or each, subsea structure to receive electrical power from the subsea structure. Electrical power routed via the subsea structure may be used to charge batteries of an AUV docked with the basket. Provision may also be made to effect data communications with the AUV with data being communicated between the subsea structure and the basket.

34 Claims, 8 Drawing Sheets

(56) References Cited

U.S. PATENT DOCUMENTS

| | | | | |
|---|---|---|---|---|
| 6,808,021 | B2 | 10/2004 | Zimmerman et al. | |
| 8,109,223 | B2 | 2/2012 | Jamieson | |
| 2008/0302292 | A1* | 12/2008 | Ruggaber | B63C 7/16<br>114/322 |

FOREIGN PATENT DOCUMENTS

| | | |
|---|---|---|
| WO | WO 2012/156425 | 11/2012 |
| WO | WO 2013/050411 | 4/2013 |

* cited by examiner

SUBSEA HOSTING OF UNMANNED UNDERWATER VEHICLES

This invention relates to subsea hosting of unmanned underwater vehicles (UUVs), for example using hardware already positioned on the seabed for the production of oil and gas.

It is often necessary to perform tasks such as inspection, monitoring, maintenance and construction during subsea operations. Below diver depth, such tasks are generally performed by unmanned underwater vehicles (UUVs) such as remotely-operated vehicles (ROVs) and autonomous underwater vehicles (AUVs).

ROVs are characterised by a physical connection to a surface support ship via an umbilical tether that carries power and data including control signals. They are typically categorised as either work-class ROVs or inspection-class ROVs.

Work-class ROVs are large and powerful enough to perform a variety of subsea maintenance and construction tasks, for which purpose they may be adapted by the addition of specialised skids and tools in a modular, interchangeable fashion. Such tools may, for example, include torque tools and reciprocating tools driven by hydraulic or electric motors or actuators.

Inspection-class ROVs are smaller but more maneuverable than work-class ROVs to perform inspection and monitoring tasks, although they may also perform light maintenance tasks such as cleaning using suitable tools. In addition to visual inspection using lights and cameras, inspection-class ROVs may hold sensors in contact with, or in proximity to, a subsea structure such as a pipeline to inspect and monitor its condition or other parameters.

AUVs are autonomous, robotic counterparts of ROVs. AUVs are mainly used like inspection-class ROVs to perform subsea inspection and monitoring tasks. However, AUVs have occasionally been used or proposed for subsea intervention tasks like those performed by work-class ROVs. AUVs that are capable of subsea intervention tasks may be referred to as autonomous intervention vehicles or AIVs. However, the generic term 'AUV' will be used in this specification for simplicity.

AUVs move from task to task on a programmed course for limited periods without a physical connection to a support facility such as a surface support ship. They have large on-board batteries for adequate endurance but must make frequent trips to the surface or to a subsea basket, garage or dock for battery recharging.

To avoid the need for a UUV to make a lengthy trip to the surface whenever tools or sensors are to be interchanged, a set of tools or sensors may be stored in a deployment basket that is lowered to a suitable subsea location. The UUV can then fetch and carry the appropriate tool or sensor from the deployment basket to a work site.

There is a need to increase the autonomy of an AUV-based system to improve its capability to inspect and monitor elements of a subsea oil and gas production installation. There may also be a benefit in improving the capability of an AUV to perform subsea interventions.

Any solution to this problem needs to be applicable readily to existing subsea installations, preferably without the necessity of retrofit operations.

To date, AUVs have to be retrieved to the surface or have to go back to a basket or garage connected to a surface support vessel. Consequently, AUV systems are not ideally autonomous: they still typically require the presence of a surface support vessel.

Self-powered baskets may not produce enough power for simultaneously recharging an AUV and reliably exchanging data with a surface facility, especially in ultra-deep water regarded as more than 2500 m deep. A physical hard-wired link for providing electrical power from the surface facility and communication to and from a surface facility is still needed to mitigate the risk of loss of communication. In this respect, the typical range limit for efficient wireless broadband communication in water is about 200 m.

More and more subsea structures in oil and gas production fields contain electrically-powered equipment such as pumps or control systems. Those structures and their systems routinely contain electrical power systems and digital systems that interface with other subsea structures and that are connected to a surface facility by an umbilical network. Umbilicals typically contain spare electric cables that may be exploited by the invention if required.

U.S. Pat. No. 8,109,223 teaches the use of a basket and an AUV, where the basket is used as a base for AUV missions. However, the basket remains connected to a surface vessel.

In WO 2007/143457, an AUV is launched from a surface host. Subsea stations laid on the seabed are connected to the host and used as power sources and communications relays for the AUV. This does not satisfy the requirements of the invention because the subsea stations are not used for AUV stand-by and still have to be connected to the surface.

U.S. Pat. No. 6,223,675 discloses a subsea work system that comprises a tether management system connected to a subsea structure for power and data transfer, and a tethered, non-autonomous ROV permanently connected to this tether management system. The ROV may also be docked to the tether management system. The tether limits possible excursion of the ROV, which is not an autonomous vehicle. Optionally, this ROV can be used to support and recharge an AUV but the ROV is not a launch basket for the AUV. Between missions, an AUV serviced by the ROV has to return to a garage or to a surface vessel that is distinct from the ROV.

U.S. Pat. No. 6,808,021 teaches the use of a single subsea garage as a base for an AUV used for inspection and maintenance of subsea wellheads. The wellheads include docking stations for recharging the AUV and communicating. That system has the drawback that the wellheads must be designed from the outset with docking stations: the system cannot be deployed on existing fields. Docking stations are not baskets: they cannot be used to host an AUV and its tools.

U.S. Pat. No. 6,167,831 describes a carrier vessel which carries a flying craft from a surface station to a subsea structure located at the seabed. The carrier vessel is self-powered and connects to the subsea structure to receive power and data therefrom. The flying craft remains connected to the carrier vessel by a tether which supplies power and data to the flying craft when used to connect together two pipe sections on the seabed. Power is required since the flying craft includes no on-board batteries. Data is required since the flying craft is not autonomous. The flying craft is thus an ROV as opposed to an AUV and, consequently, the carrier vessel is not an ROV basket.

It is against this background that the present invention has been made.

In outline, the invention resides in a method to increase the availability of a system for inspection and maintenance of subsea oil and gas production equipment by at least one AUV. In preferred embodiments, the method comprises:

lowering at least one basket carrying an AUV to the seabed close to an existing pre-installed subsea structure that is electrically connected to a surface facility such as a production unit, whether a platform or vessel, for the provision of power and two-way data communications to the subsea structure;

remotely connecting the, or each, basket to the subsea structure, by pulling a power and data cable toward the subsea structure, that cable preferably already being connected to a basket;

coupling the distal or free end of the cable to the subsea structure, for example using a power and data interface already installed as part of the subsea structure, to effect power and data connections between the basket and the subsea structure, hence enabling the basket to access the power and data communications provided to the subsea structure by the surface facility;

using power and data routed from the surface facility through the subsea structure to charge batteries of the AUV carried by the basket and to program or interrogate the AUV;

performing AUV missions that typically comprise: flying the AUV out of the basket to a destination; inspecting or maintaining a process or equipment at the destination; meanwhile exchanging data between the AUV and the basket via a remote underwater communication system; flying the AUV back to the basket; docking the AUV with the basket; recharging the battery of the AUV and exchanging data between the docked AUV and the basket; and standing by underwater between successive missions. Between missions, the AUV can stay docked inside the basket on the seabed. The basket and the AUV need be retrieved to the surface by a surface support vessel only for periodic maintenance of the basket and/or the AUV.

If no through-water communications link is in place, the AUV can operate autonomously, carrying out its tasks as normal. However, if the AUV is within range of a communications node of the remote underwater communication system, that node can be used to communicate with and control the AUV if desired.

The invention enables long-term, substantially permanent deployment and hosting of an AUV system on subsea infrastructure, without requiring extensive modification of that infrastructure. To do so, the invention adapts an existing AUV launch basket and connects it to the infrastructure for the provision of power to the basket and optionally for the transmission of data to and from the basket.

One expression of the inventive concept is a method of hosting an autonomous underwater vehicle (AUV) at a subsea location. That method comprises: lowering at least one AUV basket to a subsea location adjacent at least one pre-installed subsea structure, which structure has provision for electrical power to be provided to it; at the subsea location, connecting the, or each, basket to a subsea structure to receive electrical power from the subsea structure by extending a power cable from the basket toward the subsea structure; and using electrical power routed via the subsea structure to charge batteries of an AUV docked with the basket. Electrical power may, for example, be provided to the subsea structure from a surface facility.

The method of the invention preferably further comprises effecting data communication with the AUV, comprising provision of programming or control data to the AUV and/or reception of feedback data from the AUV. For example, feedback data may comprise image or video data representative of images viewed by the AUV.

Data communication is preferably effected with the AUV via the basket. In that case, data communication is suitably effected between the basket and the subsea structure, and between the subsea structure and a surface facility. From there, data communication may be effected with a remote station, preferably situated on land, at which a human AUV operator may be located.

A common connection element such as a jumper may provide electrical power from the subsea structure to the basket and effect data communication between the subsea structure and the basket.

Data communication is suitably effected between the AUV and the basket while the AUV is docked with the basket. For example, data stored by the AUV during a mission may be transferred to the basket when the AUV is docked with the basket. Nevertheless, data communication is preferably effected between the AUV and the basket while the AUV is undocked from the basket, more preferably by a wireless connection between the AUV and the basket. Where data communication with the AUV is effected wirelessly, the AUV may be operated autonomously in the absence of an effective wireless data communication signal. Nevertheless, data communication between the AUV and the basket could be effected via a tether connection between them.

Advantageously, the AUV may be flown around a mesh network of subsea data communication nodes connected for data communication with a surface facility, each of those nodes being capable of effecting data communication between the AUV and the surface facility when the AUV is within wireless data communication range of that node.

Data communication with the AUV may be effected via a pre-installed subsea structure or a subsea data communication node of a pre-installed subsea structure, instead of or in addition to data communication between the AUV and the basket.

It is possible for least one AUV basket to be lowered to the subsea location without an AUV being docked with that basket. It is also possible for at least one AUV to dock with and communicate with any of a plurality of AUV baskets.

The inventive concept may also be expressed as a system for hosting an autonomous underwater vehicle (AUV) at a subsea location. That system comprises: at least one subsea structure being part of a production installation pre-installed on the seabed, which structure has provision for electrical power to be provided to it; at least one AUV basket that is distinct from the subsea structure and has been lowered to a subsea location adjacent the subsea structure; and a connection element extending between the basket and the subsea structure through which the basket can receive electrical power from the subsea structure for supply to an AUV docked with the basket. The connection element is pre-installed on the basket and is extensible from a stored state on the basket to a deloyed stated to extend between the basket and the subsea structure.

The system of the invention suitably further comprises a surface facility from which electrical power may be provided to the subsea structure. At least one wireless transmitter or tether may be provided for effecting data communication with the AUV, which transmitter or tether suitably acts between the AUV and the basket.

The inventive concept also embraces an AUV basket that is adapted for use in the method or the system of the invention. Specifically, in accordance with the invention, an AUV basket arranged to be lowered to a subsea location comprises a pre-installed connection element that is extensible at the subsea location from a stored state on the basket to a deployed state, to extend between the basket and a subsea structure from which the basket can receive electrical power through the connection element. That connection element is suitably also arranged to effect data communications between the basket and the subsea structure.

In order that the invention may be more readily understood, reference will now be made, by way of example, to the accompanying drawings in which.

Figure 1:
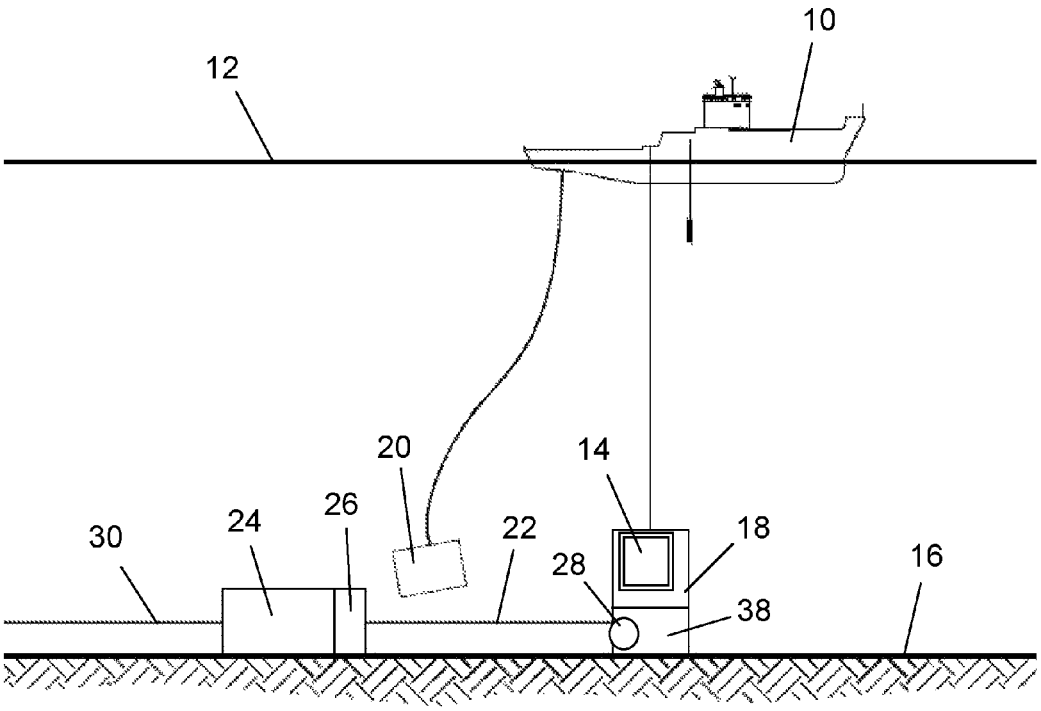
FIG. 1 is a schematic side view of a launch basket containing an AUV, which basket has been lowered to the seabed from an ROV support vessel and connected by a jumper to subsea infrastructure in accordance with the invention.

Referring to FIG. 1, an ROV support vessel 10 at the surface 12 lowers an AUV 14 to the seabed 16 in a launch basket 18. By way of example, the water at this location may be 3000 meters deep and hence regarded in the subsea oil and gas industry as ultra-deep. An ROV 20 tethered to the vessel 10 then connects a jumper 22 extending across or over the seabed 16 to bridge a gap between the launch basket 18 and nearby pre-installed subsea infrastructure 24 such as production hardware. As just one of many examples, the subsea infrastructure 24 could be a manifold, although this is not essential.

Specifically, the jumper 22 is connected to a power and data interface 26 of the subsea infrastructure 24. The power and data interface 26 may be a standard interface that is routinely provided on subsea equipment to connect one item of equipment to another for electrical power and data communications.

Conveniently, the jumper 22 is pre-attached to the launch basket 18 at the surface 12 to be connected to the power and data interface 26 of the subsea infrastructure 24 in one simple connection operation upon reaching the seabed 16. For example, the jumper 22 may be stored on a reel 28 on the launch basket 18 to be pulled from the reel 28 into an extended or deployed configuration for connection to the power and data interface 26 of the subsea infrastructure 24. The jumper 22 may also be described in the art as an umbilical or a flying lead.

After completing commissioning checks, the ROV support vessel 10 recovers the ROV 20 and departs for other duties.

Figure 2:
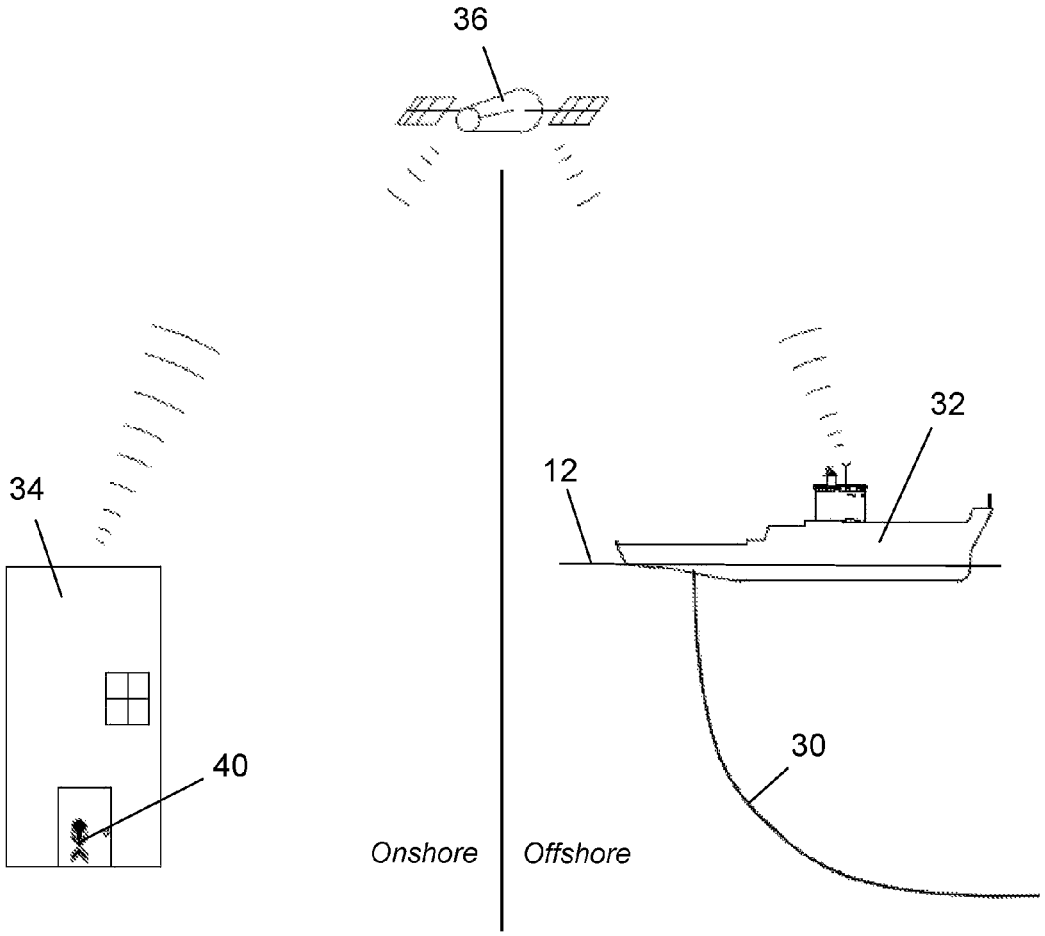
FIG. 2 is a diagram representing onshore-offshore communications via satellite.

In this example, an umbilical 30 provides power and communications data from a host facility 32 to the subsea infrastructure 24. The host facility 32 may, for example, be an FPSO at the surface 12 as shown in FIG. 2. The host facility 32 may communicate with a remote station 34, most conveniently via a satellite broadband system 36. Any such remote station 34 will typically, but not necessarily, be situated on land. An onshore-offshore system is shown in FIG. 2, with onshore elements to the left and offshore elements to the right.

The jumper 22 that connects the launch basket 18 to the subsea infrastructure 24 supplies power from the subsea infrastructure 24 to the launch basket 18 and also serves as a two-way communication link to transfer communications data between the subsea infrastructure 24 and the launch basket 18.

The launch basket 18 is modified from a standard design by the addition of a dedicated interface module 38. The interface module 38 acts as a gateway for two-way data transfer via the jumper 22 between the AUV 14 and a subsea data network that comprises the subsea infrastructure 24. To perform this gateway function, the interface module 38 interfaces a communications modem of the basket 18 with the subsea data network. The communications modem is typically designed to carry optical communications data, as will be explained.

The interface module 38 also buffers power supplied through the jumper 22 to facilitate recharging of on-board batteries of the AUV 14, when the AUV 14 is docked in the launch basket 18 for recharging in a well-known manner. Thus, for example, the interface module 38 transforms the voltage of the subsea production supply from the subsea infrastructure 24 to enable the batteries of the AUV 14 or intermediate batteries of the launch basket 18 to be trickle-charged.

An operator 40 may be located on board the surface host facility 32 or at the remote station 34. Thus, data communication between the operator 40 and the AUV 14 connected to the launch basket 18 is effected via the umbilical 30, the subsea infrastructure 24 and the jumper 22. Collectively, therefore, the umbilical 30, the subsea infrastructure 24 and the jumper 22 are elements of a communications link between the operator 40 and the AUV 14. A further element of that communications link is a data connection between the AUV 14 and the launch basket 18, as will be explained. The communications link may also comprise a data connection between the host facility 32 and the remote station 34, such as a satellite broadband system 36 as noted above. In principle, a hard-wired data connection between the host facility 32 and the remote station 34 would also be possible.

Data carried by the communications link may include mission-planning data; mission plan data; remote maintenance or diagnosis data; or still images or video signals representing what the AUV 14 can see through its on-board cameras. Video signals may be low-resolution or higher resolution depending upon the bandwidth afforded by the various successive elements of the communications link, most critically the data connection between the launch basket 18 and the AUV 14.

Figure 3:
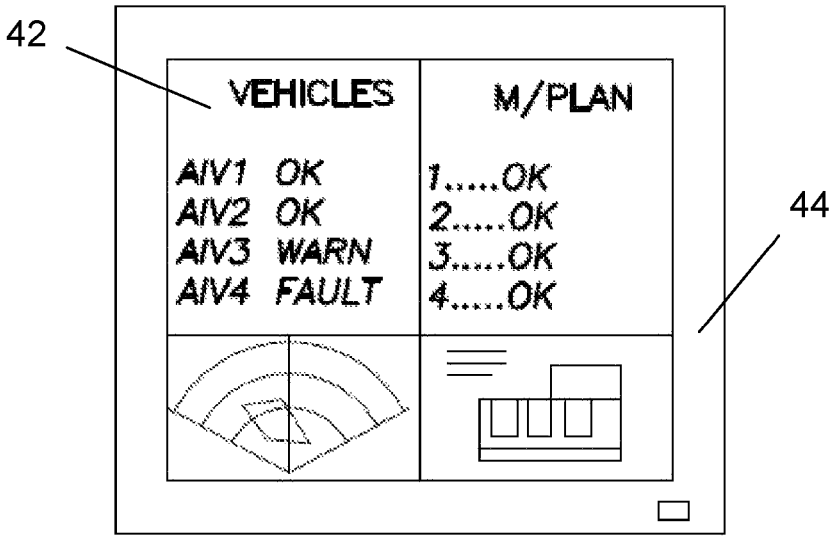
FIG. 3 is a schematic plan view of a monitor, being part of an operator's console at a host facility or a remote location in the system of the invention.

The operator 40 can plan missions offshore aboard the host facility 32 or at the remote station 34, which may be onshore as shown in FIG. 2, in an office that serves as a campaign planning centre. FIG. 3 represents a monitor 42 of an operator's console 44, which may be at the host facility 32 or at the remote station 34 as appropriate. Multiple AUVs in a fleet may be supported and controlled from one console 44. Here, an operator 40 can conduct commissioning checks on the system, run test missions and plan real missions. Mission plans are then uploaded to the AUV 14 via the communications link. The communications link is also used to send stop and start commands to the AUV 14.

While there is an effective data communications link between the launch basket 18 and the AUV 14, the operator 40 can assume tele-robotic control of the AUV 14 and guide it in a mode akin to 'DP ROV' mode of an ROV (ROV dynamic positioning). Also, bandwidth permitting, video signals from cameras carried by the AUV 14 may be streamed back to the monitor 40 of the operator's console 42 via the communications link. This allows the AUV 14 to remain on station under tele-robotic control of the operator 40, observing a subsea process, an item of subsea hardware or performing a task while relaying pictures to the surface. Thus, the operator 40 can view, monitor and if necessary control execution of missions in real time.

Data communication may be effected between the AUV 14 and the launch basket 18 in different ways, depending upon whether the AUV 14 is tethered to the launch basket 18 or untethered from the launch basket 18.

Figure 4:
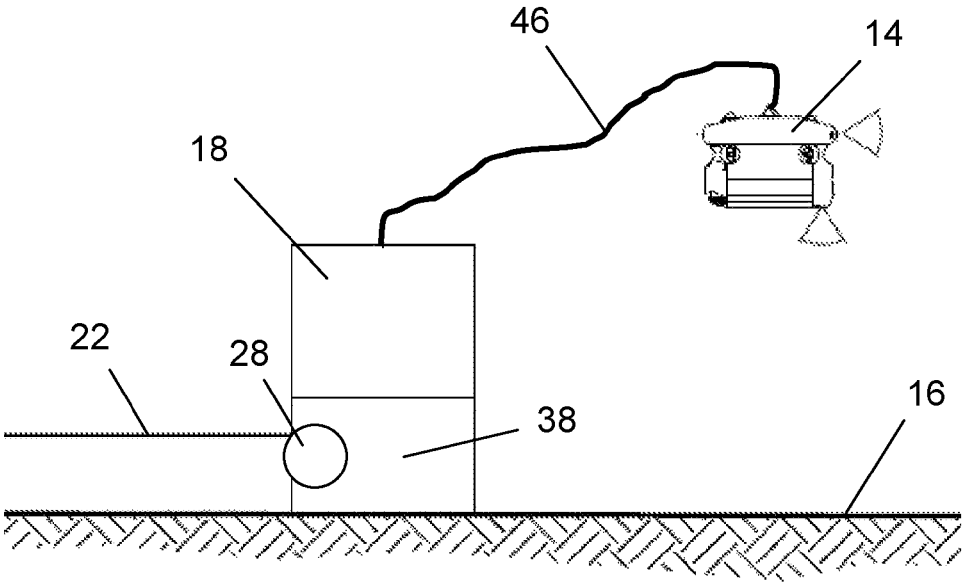
FIG. 4 is a schematic side view showing an AUV undocked from the launch basket to perform an inspection operation while in a tethered mode.

In a tethered mode shown in FIG. 4, a tether 46 between the AUV 14 and the launch basket 18 contains a hard physical data connection such as a fibre-optic connection to enable real-time control of the AUV 14, akin to DP ROV mode. That connection also provides for the transmission of video signals. Of course, the length of the tether 46 limits the excursion range or working radius of the AUV 14 relative to the launch basket 18 when in tethered mode.

Figure 5:
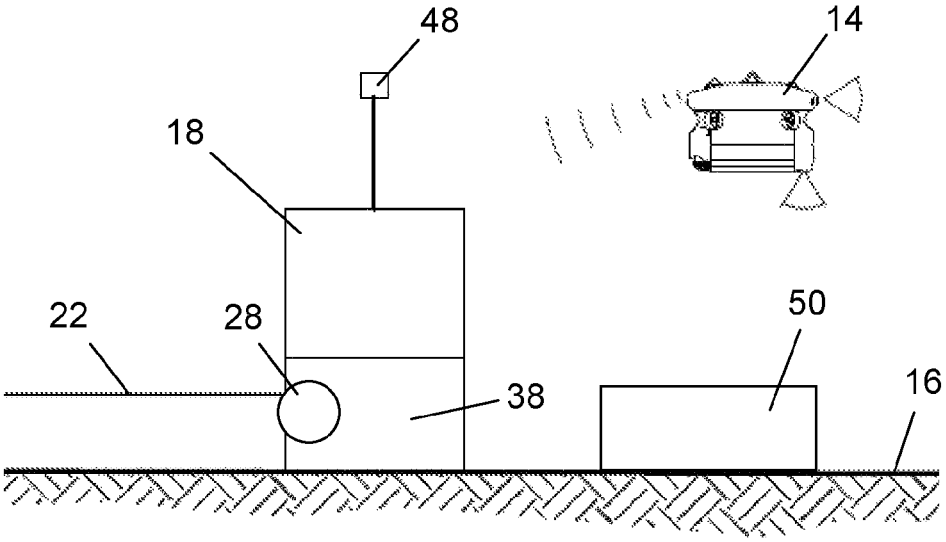
FIG. 5 is a schematic side view showing the AUV undocked from the launch basket and performing an inspection operation while in an untethered mode.

The alternative of an untethered mode shown in FIG. 5 relies upon wireless communication with the AUV 14. This frees the AUV 14 from limits of its excursion arising from the length of the tether 46, although the maximum working range of the AUV 14 while operating non-autonomously or semi-autonomously is then governed by the capability of the wireless link to support real-time communication.

Wireless communication is via a transducer 48 that effects a high-bandwidth free-space optical data link. An acoustic data link may also be an option but is currently less preferred in view of its lower bandwidth. Subsea optical and acoustic data links are well known in the art and require no elaboration here.

The transducer 48 is shown in FIG. 5 mounted on the launch basket 18 but the transducer 48 may instead be mounted on other subsea hardware, which could for example form part of the subsea infrastructure 24 from which the launch basket 18 receives its power.

In principle, the AUV 14 is capable of fully autonomous fly-to-place inspection and tooling operations. This means that the AUV 14 can be programmed to carry out missions fully autonomously, without human intervention. However, a semi-autonomous approach may be chosen instead, involving close real-time monitoring as a prelude to human intervention in case such intervention becomes necessary.

On receiving a start command via the communications link from an operator 40 at the surface, the AUV 14 autonomously undocks from the launch basket 18 as shown in FIG. 5 and begins its mission. That mission may, for example, be to carry out an inspection of an item of subsea hardware 50 or to monitor a subsea process. The mission can be conducted fully autonomously or semi-autonomously, depending upon the range and status of the communications link between the AUV 14 and the transducer 48 mounted on the launch basket 18 or on other subsea hardware.

For example, in semi-autonomous operations, real-time monitoring of the AUV 14 may be maintained during a mission for as long as the AUV 14 remains within a distance from the transducer 48 that is short enough for effective real-time wireless data communication to be maintained. If the AUV 14 flies beyond a distance from the transducer 48 at which effective real-time wireless data communication can be maintained, the AUV 14 operates fully autonomously until such time as effective data communication is regained. However, the operator 40 can continue to monitor the AUV 14 while it operates fully autonomously, using well-known acoustic technology.

To mitigate limits on excursion range while maintaining effective real-time wireless data communication, multiple transducers 48 could be placed around a subsea installation. This enables the AUV 14 to operate in a subsea mesh network comprising multiple nodes defined by the transducers 48. Each transducer 48 of the mesh network has an associated individual communication link to the operator's console 44, for example via a jumper to a data interface on another item of subsea hardware and from there via an umbilical to the surface.

Figure 6:
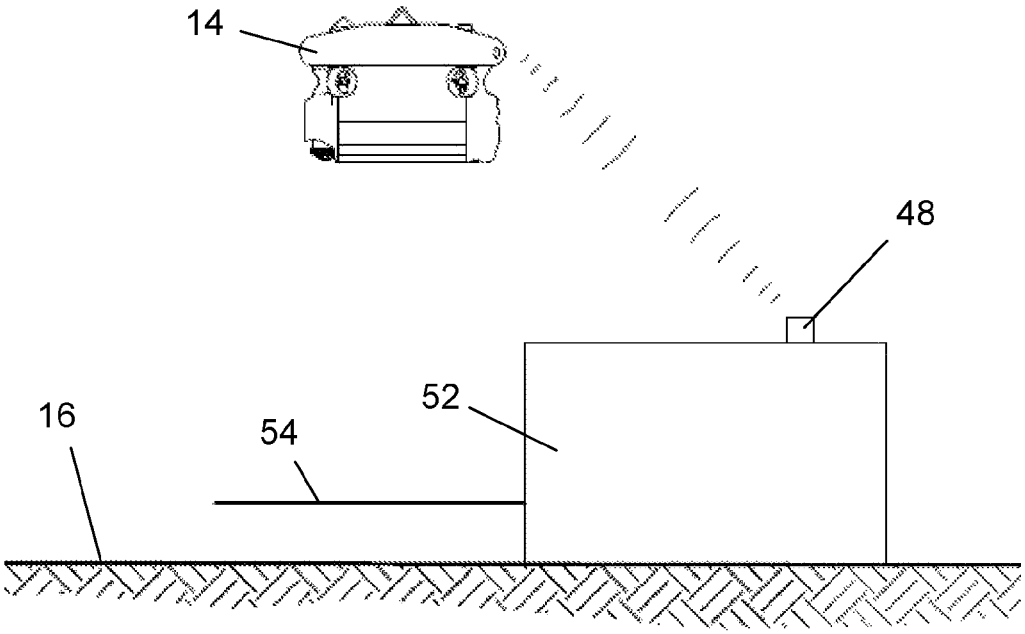
FIG. 6 is a schematic side view showing the AUV interacting with a transducer on a remote item of subsea hardware, as part of a mesh network.

By use of a mesh network, real-time communications can be established and maintained between the AUV 14 and transducers 48 mounted on different items of subsea hardware as the AUV 14 flies around a subsea installation. In this respect, FIG. 6 shows an additional transducer 48 mounted on another item of subsea hardware 52 by way of example. That item of subsea hardware 52 may be independent of the subsea infrastructure 24 from which the launch basket 18 receives its power, or it may form part of that subsea infrastructure 24.

In this example, the item of subsea hardware 52 is powered and provided with data communications via a further umbilical 54.

Figure 7:
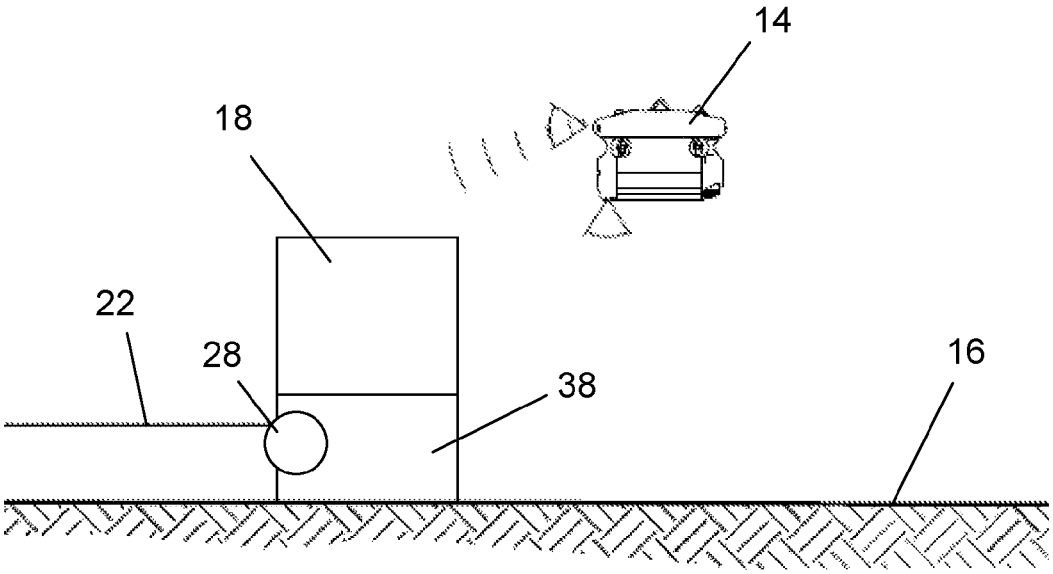
FIG. 7 is a schematic side view showing the AUV returning to the launch basket at the end of a mission, for recharging and optional reprogramming.

When the AUV 14 has collected the desired inspection data or the monitored process or intervention task is complete, the AUV 14 returns autonomously to dock with the launch basket 18 to recharge its on-board batteries. FIG. 7 shows the AUV 14 approaching the basket 18. After the batteries of the AUV 14 are sufficiently charged, the AUV 14 remains docked with the basket 18 to await further instructions. The docked AUV 14 can be reprogrammed if necessary and then redeployed on further missions.

Optionally, once docked with the launch basket 18, the AUV 14 can perform a full data download of stored video, sonar and navigation data to be transmitted via a data buffer in the interface module 38 of the basket 18 along the jumper 22, through the subsea infrastructure 24 and up the umbilical 28 for further detailed analysis or processing at the surface.

Figure 8:
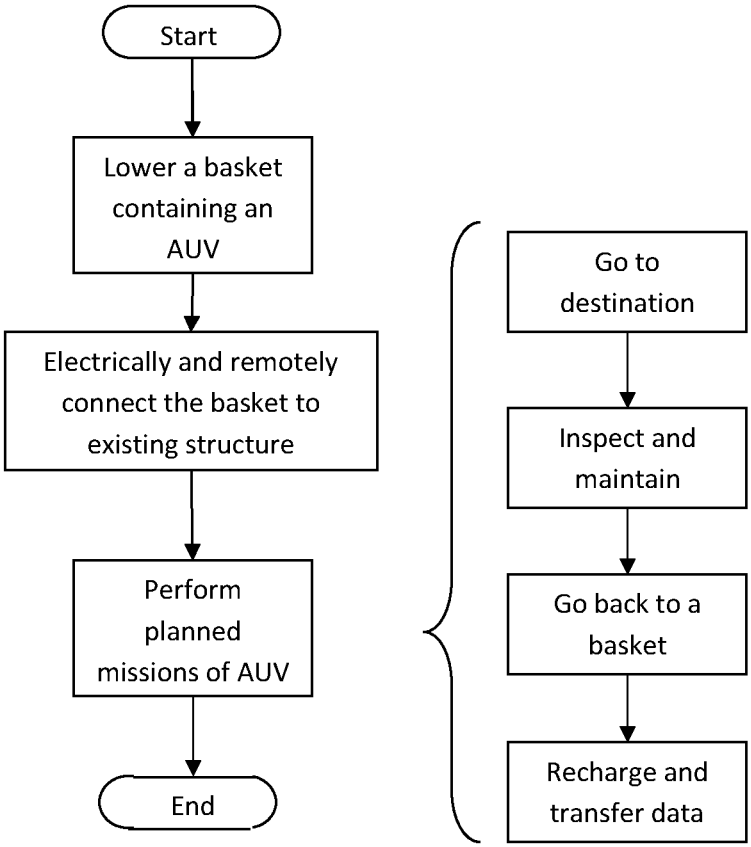
FIG. 8 is a flow diagram of some principal method steps of the invention.

To aid understanding of the entire system of the invention, FIG. 8 shows the AUV 14 undocked from the launch basket 18 and flown to inspect an item of subsea infrastructure 24 that provides power and communications data to the launch basket 18 via the jumper 22. To receive power and communications data, the item of subsea infrastructure 24 is connected by an umbilical 30 to a host facility 32, again exemplified here by surface vessel such as an FPSO.

During its inspection mission, the AUV 14 receives control signals from, and returns feedback and video signals to, an optical transducer 48 on the launch basket 18. The transducer 48 on the launch basket 18 forms part of the communications link between the AUV 14 and an operator 40, who as mentioned above may be on board the FPSO or based at a remote station 34 that communicates with the FPSO.

FIG. 8 is flow diagram that sets out various method steps as explained above.

Figure 9:
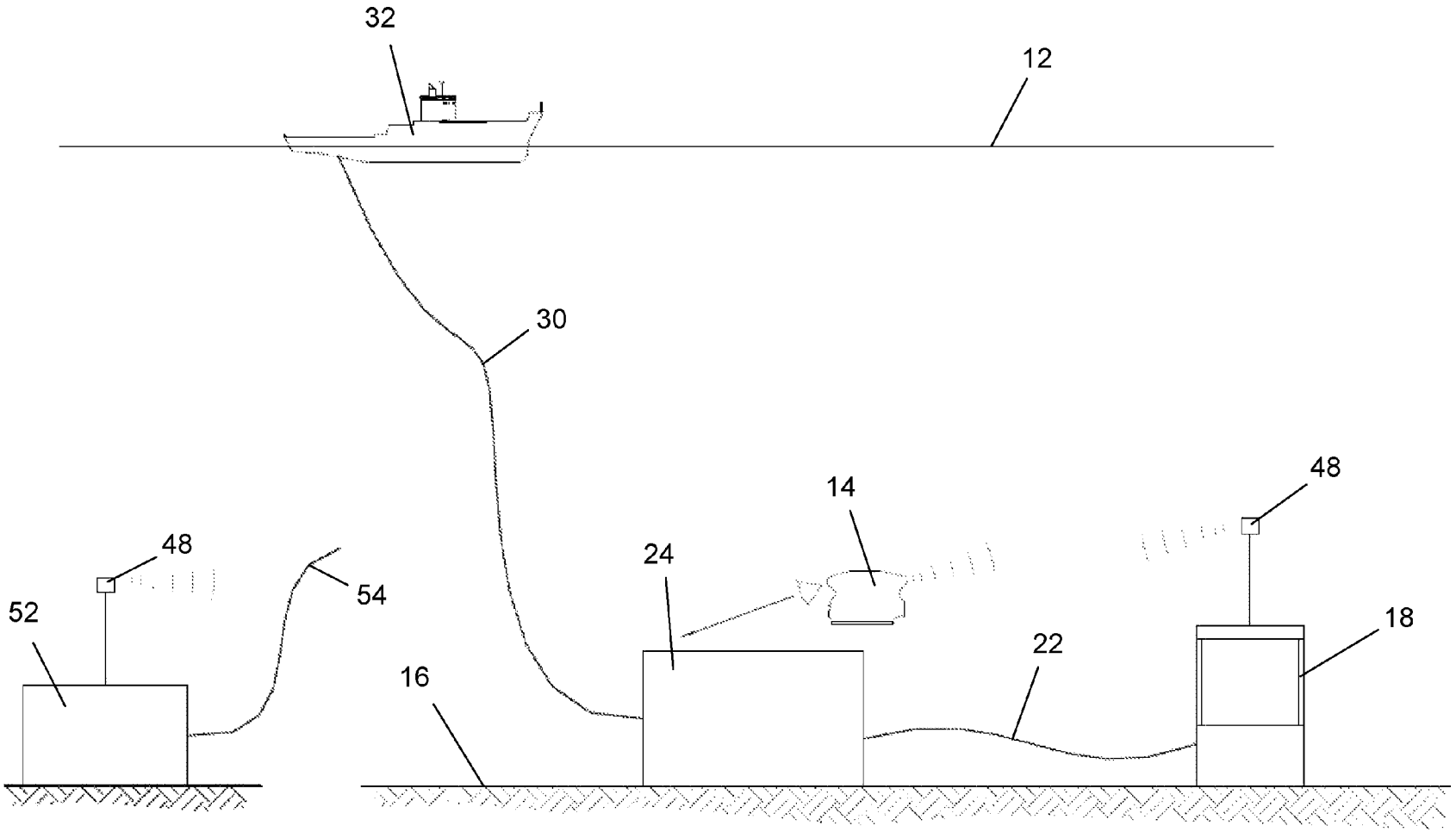
FIG. 9 is a schematic side view of a system of the invention embodied as a mesh network.

In the example shown in FIG. 9, an additional, remote item of subsea hardware 52 is also connected to a surface vessel by a separate umbilical 54 to receive power and communications. This additional, remote item of subsea hardware 52 carries an additional transducer 48 with which the AUV 14 can communicate as part of a mesh network, as an alternative to being tied to communicate only with the transducer 48 on the launch basket 18. Again, the item of subsea hardware 52 is powered and provided with data communications via a further umbilical 54, which may or may not be connected directly to the host facility 32 at the surface 12.

Figure 10:
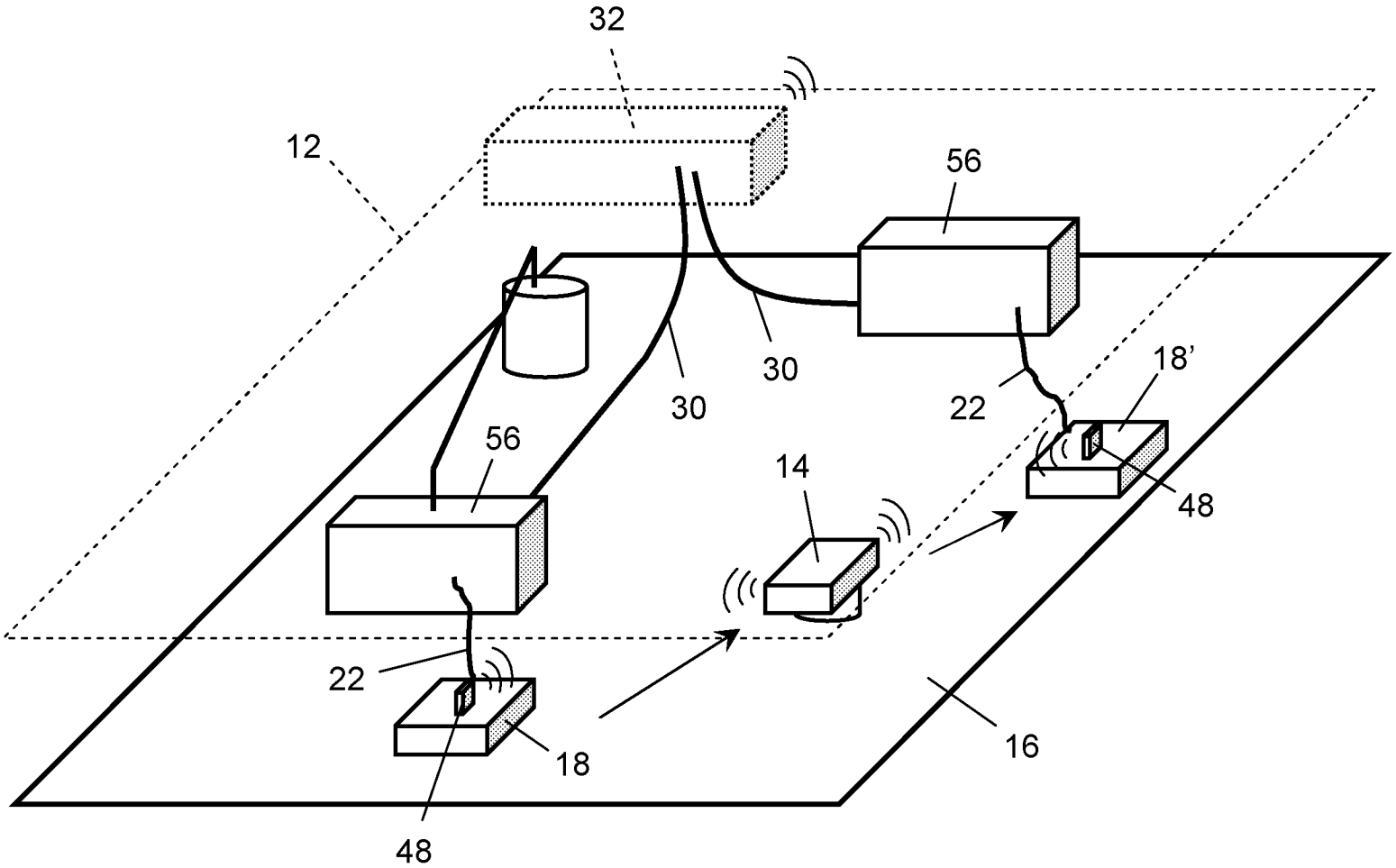
FIG. 10 is a schematic perspective view of a subsea installation equipped with the system of the invention, here embodied with multiple baskets between which an AUV may travel for recharging, if docked, and for data communication.

Finally, FIG. 10 shows another option, in which one or more empty launch baskets 18 can be lowered to the seabed 16 to interact with an AUV 14 in subsequent operations. Here, one AUV 14 is shown navigating between two distinct baskets 18 on the seabed 16. However, the baskets 18 may be at other subsea locations; there may also be more than one AUV 14 travelling between, and interacting with, more than two baskets 18.

In FIG. 10, a host facility 32 such as an FPSO at the surface 12 provides power and communications to two items of subsea hardware 56 on the seabed 16 via respective umbilicals 30. The host facility 32 also communicates above the surface 12 with a remote station that is not shown here, for example wirelessly via a satellite broadband system as previously described.

In this simple example, two launch baskets 18, 18' have been lowered to the seabed 16 at separate locations, one adjacent each of the respective items of subsea hardware 56. Respective jumpers 22 have connected the baskets 18, 18' to the adjacent items of subsea hardware 56. However, one item of subsea hardware 56 could be connected by two or more jumpers 22 to two or more such baskets 18, 18'.

As before, the jumpers 22 supply power from the items of subsea hardware 56 to the associated launch baskets 18, 18'. The jumpers 22 also serve as two-way communication links to transfer communications data between the items of subsea hardware 56 and the associated baskets 18, 18'. Each basket 18, 18' has a respective transducer 48 for effecting wireless data communication with the AUV 14 through the water.

FIG. 10 shows the AUV 14 traversing a gap between the launch baskets 18, 18', specifically moving from a first basket 18 to a second basket 18'. For example, the AUV 14 may have undocked from the first basket 18 after recharging, reprogramming and/or data download, with a view to performing one or more tasks en route to the second basket. There, the AUV 14 will later dock again for further recharging, further reprogramming and/or further data download.

While the AUV 14 remains within effective data communication range of the transducer 48 of either of the baskets 18, 18', that basket 18, 18' can serve as a communications node via which the AUV 14 can communicate and be communicated with. Specifically, via that node, the AUV 14 can receive and respond to control signals initiated by a surface operator and can return feedback signals to the surface via the associated jumper 22, item of subsea hardware 56 and umbilical 30 leading to the surface host facility 32.

If the AUV 14 travels beyond the effective data communication range of the transducers 48 of the baskets 18, 18'—and indeed beyond effective data communication range from any other transducers (not shown in FIG. 10) that may be placed at other subsea locations as part of a mesh network—the AUV 14 reverts to autonomous operation. The AUV 14 maintains autonomous operation, albeit preferably while being monitored acoustically, until it again comes within effective data communication range of a transducer 48—which may be a different transducer 48 of the system, for example the transducer 48 on the second basket 18'. If required, the AUV 14 can then again receive and respond to control signals initiated by a surface operator and can return feedback signals to the surface.

Whilst the invention enables long-term, substantially permanent subsea deployment and hosting of an AUV system via subsea infrastructure, elements of the system may require periodic recovery to the surface for cleaning and maintenance. For example: marine growth may be cleaned off; anti-corrosion anodes may be replaced; and thrusters, launch basket hydraulics, sensors and other moving parts may be replaced or maintained. If desired, the system or its elements may be swapped out to minimise downtime.

Many variations are possible within the inventive concept. For example, the jumper 22 extending between the launch basket 18 and the subsea infrastructure 24 could be installed differently: the jumper 22 could be pre-attached to the subsea infrastructure 24 or could be installed in a subsequent operation. However, the preceding embodiments envisage that the jumper 22 may be stored on the basket 18, for example on a reel 28 as noted above, and may be permanently electrically connected to the basket 18.

Involvement of the ROV 20 is also optional, as the jumper 22 could be pulled from the launch basket 18 and connected to the subsea infrastructure 24 by the AUV 14.

The jumper 22 need not necessarily include a data carrier and so may be simply an electrical power cable, if data can be communicated remotely between a basket 18 and the subsea infrastructure 24 or a surface host facility 32.

Provision may be made to store energy on the basket for subsequent transfer to a docked AUV. In practical terms, an energy storage system on the basket may be trickle-charged slowly but constantly over a long period of time. However, that energy storage system may then transfer energy to the AUV at a faster rate when the AUV is docked to the basket. If its capacity is large enough, the energy storage system of the basket can potentially hold enough energy for multiple AUV recharges.

The invention claimed is:

1. A method of hosting an autonomous underwater vehicle (AUV) at a subsea location, the method comprising:

lowering at least one AUV basket, without self-propulsion, to a subsea location adjacent at least one pre-installed subsea structure, which structure has provision for electrical power to be provided to it;

at the subsea location, connecting the, or each, basket to a subsea structure by extending a power cable from the, or each, basket toward the subsea structure to receive electrical power from the subsea structure; and using electrical power routed via the subsea structure to charge batteries of an AUV docked with the basket.

2. The method of claim 1, wherein electrical power is provided to the subsea structure from a surface facility.

3. The method of claim 1, further comprising effecting data communication with the AUV, that data communication comprising provision of programming or control data to the AUV and/or reception of feedback data from the AUV.

4. The method of claim 3, wherein the feedback data comprises image or video data representative of images viewed by the AUV.

5. The method of claim 3, wherein data communication is effected with the AUV via the basket.

6. The method of claim 5, wherein data communication is effected between the basket and the subsea structure.

7. The method of claim 6, wherein data communication is effected between the subsea structure and a surface facility.

8. The method of claim 7, wherein data communication is effected wirelessly between the surface facility and a remote station at which a human AUV operator may be located.

9. The method of claim 8, wherein the remote station is situated on land.

10. The method of claim 5, wherein a common connection element provides electrical power from the subsea structure to the basket and effects data communication between the subsea structure and the basket.

11. The method of claim 5, wherein data communication is effected between the AUV and the basket while the AUV is docked with the basket.

12. The method of claim 11, wherein data stored by the AUV during a mission is transferred to the basket when the AUV is docked with the basket.

13. The method of claim 5, wherein data communication is effected between the AUV and the basket while the AUV is undocked from the basket.

14. The method of claim 13, wherein data communication between the AUV and the basket is effected via a wireless connection between the AUV and the basket.

15. The method of claim 5, wherein data communication with the AUV is effected wirelessly, and the AUV is operated autonomously in the absence of an effective wireless data communication signal.

16. The method of claim 3, comprising flying the AUV around a mesh network of subsea data communication nodes connected for data communication with a surface facility, each of those nodes being capable of effecting data communication between the AUV and the surface facility when the AUV is within wireless data communication range of that node.

17. The method of claim 3, comprising effecting data communication with the AUV via a pre-installed subsea structure or a subsea data communication node of a pre-installed subsea structure, instead of or in addition to data communication between the AUV and the basket.

18. The method of claim 3, wherein data communication between the AUV and the basket is effected via a tether connection between the AUV and the basket.

19. The method of claim 1, wherein the power cable is pre-installed on the basket and is extended from a stored state on the basket to a deployed state extending between the basket and the subsea structure.

20. The method of claim 1, wherein at least one AUV basket is lowered to the subsea location without an AUV being docked with that basket.

21. The method of claim 20, wherein at least one AUV docks with and communicates with any of a plurality of AUV baskets.

22. A system for hosting an autonomous underwater vehicle (AUV) at a subsea location, the system comprising:

at least one subsea structure being part of a production installation pre-installed on the seabed, which structure has provision for electrical power to be provided to it;

at least one AUV basket, without self-propulsion, that is distinct from the subsea structure and has been lowered to a subsea location adjacent the subsea structure; and a connection element extending between the basket and the subsea structure through which the basket can receive electrical power from the subsea structure for supply to an AUV docked with the basket, wherein the connection element is pre-installed on the basket and is extensible from a stored state on the basket to a deployed state to extend between the basket and the subsea structure.

23. The system of claim 22, further comprising a surface facility from which electrical power is provided to the subsea structure.

24. The system of claim 22, further comprising at least one wireless transmitter or tether for effecting data communication with the AUV.

25. The system of claim 24, wherein the transmitter or the tether acts between the AUV and the basket.

26. The system of claim 25, further comprising a data communication link between the basket and the subsea structure.

27. The system of claim 26, wherein the data communication link between the basket and the subsea structure is a wired link.

28. The system of claim 22, further comprising a data communication link between the subsea structure and a surface facility.

29. The system of claim 28, further comprising a wireless data communication link between the surface facility and a remote station at which a human AUV operator may be located.

30. The system of claim 29, wherein the remote station is situated on land.

31. The system of claim 22, wherein a common connection element provides electrical power from the subsea structure to the basket and also effects data communication between the subsea structure and the basket.

32. The system of claim 22, comprising a mesh network of subsea data communication nodes connected for data communication with a surface facility, each of those nodes being capable of effecting data communication between the AUV and the surface facility when the AUV is undocked from the basket during a mission and is within wireless data communication range of that node.

33. An AUV basket, without self-propulsion, arranged to be lowered to a subsea location, the basket comprising a pre-installed connection element that is extensible at the subsea location from a stored state on the basket to a deployed state, to extend between the basket and a subsea structure from which the basket can receive electrical power through the connection element.

34. The basket of claim 33, wherein the connection element is also arranged to effect data communications between the basket and the subsea structure.

* * * * *